US005134746A

United States Patent [19]

William

[11] Patent Number: 5,134,746

[45] Date of Patent: Aug. 4, 1992

[54] CLEANING MATERIAL

[76] Inventor: Steven William, 4041 Bruner Rd., Daytona Beach, Fla. 32119

[21] Appl. No.: 448,668

[22] Filed: Dec. 11, 1989

[51] Int. Cl.[5] ..... A47L 13/10; A41D 19/00

[52] U.S. Cl. ..... 15/227; 15/229.11; 2/158; 2/159; 2/167

[58] Field of Search ..... 15/209 R, 209 B, 209 C, 15/227, 195; 2/158, 161 R, 167, 159; 428/92, 95, 36.5; 51/391

[56] References Cited

U.S. PATENT DOCUMENTS

| | | | |
|---|---|---|---|
| 1,782,502 | 11/1930 | Crane | 15/227 |
| 2,690,661 | 10/1954 | Briggs | 15/227 |
| 2,717,437 | 9/1955 | DeMestral | 428/92 |
| 2,821,731 | 2/1958 | May | 15/227 |
| 3,126,572 | 3/1964 | Franey | 15/209 R |
| 3,151,333 | 10/1964 | Scholz | 15/227 X |
| 3,414,928 | 12/1968 | Lemelson | 15/209 CX |
| 3,421,171 | 1/1969 | Tsuruzawa | 15/172 |
| 3,634,901 | 1/1972 | Landsberg | 15/209 C X |
| 3,638,270 | 2/1972 | Schlegel et al. | 15/114 |
| 3,643,386 | 2/1972 | Grzyll | 51/391 |
| 4,038,787 | 8/1977 | Bianchi | 51/391 |
| 4,051,572 | 10/1977 | Greenwood | 15/227 |
| 4,065,826 | 1/1978 | Hough | 15/227 |
| 4,107,840 | 8/1978 | Kupperman et al. | 30/172 |
| 4,356,220 | 10/1982 | Benedyk | 428/92 X |
| 4,621,388 | 11/1986 | Ortolivo | 15/227 |
| 4,670,930 | 6/1987 | Lu | 2/158 X |
| 4,884,374 | 12/1989 | Natale et al. | 15/227 X |
| 4,953,250 | 9/1990 | Brown | 15/227 |
| 4,980,943 | 1/1991 | Barber | 15/227 |

FOREIGN PATENT DOCUMENTS

| | | | |
|---|---|---|---|
| 2278277 | 3/1976 | France | 15/227 |
| 585417 | 2/1947 | United Kingdom | 51/391 |

*Primary Examiner*—Henry J. Recla
*Assistant Examiner*—Glenn T. Barrett
*Attorney, Agent, or Firm*—Lerner, David, Littenberg, Krumholz & Mentlik

[57] ABSTRACT

A cleaning material designed for removing difficult stains and dirt from smooth and textured surfaces. The material is made of a plurality of flat chisellike synthetic fibers which are somewhat pliant and protrude from a backing designed to hold the fibers in place. The material may be embodied in the shape of a mitt to fit over the hand of the user with a backing suitable to protect the user's hands. The material may also be configured in other fashions and in combination with different backings and attached to various instruments to provide greater ease of use for particular cleaning chores.

4 Claims, 6 Drawing Sheets

CLEANING MATERIAL

FIELD OF INVENTION

This invention provides for an effective cleaning material which is nonabrasive and ideally suited for difficult stains on smooth or slightly textured and delicate surfaces in addition to being useful for a multitude of less demanding cleaning tasks.

Heretofore, when cleaning delicate surfaces a choice had to be made between effective but abrasive cleaning materials (such as steel wool) with the potential for damaging the surface cleaned, or cleaning with a nonabrasive material (such as cloth or sponge) that would not damage the surface but would prove ineffective on many types of caked-on dirt. Synthetic materials have fallen short of this need because of the shape of the fibers.

The more effective cleaning materials work well because of the rigidity and hardness of the material (e.g. steel wool, wire brushes, sandpaper) because they will not yield to or roll over a caked-on stain. However, the very unyielding quality of such a cleaning material tends to also be unyielding to the surface being cleaned and would damage a delicate surface. In addition the more rigid the material the more limited is the ability to produce forms of the material that would lend themselves to ease of use. On the other hand, nonabrasive materials that would be safe for delicate surfaces due to their soft and yielding quality (e.g. sponges, cloths, and circular fibered synthetics) are not effective to many caked-on stains because they will yield to or roll over the direct. Therefore, most users would find it desirable to have a single cleaning material that would facilitate efforts to remove caked-on stains and dirt from delicate surfaces without damaging the surface to be cleaned in addition to being useful on a number of less demanding dirt and surface combinations. Heretofore this need has not been adequately addressed.

Accordingly, this invention is designed to address the need for an effective cleaning material for tough cleaning chores involving delicate surfaces as well as being suitable to many less demanding cleaning problems. The invented material is made of a plurality of flat chisel-like synthetic fiber tufts protruding from a backing designed to hold the fiber tufts in place. The synthetic fibers are flat and cut on their ends in a manner to produce in effect a small chisel or razor blade-like plastic. The fibers are somewhat flexible in order to allow them to lie down parallel to the surface to be cleaned. At the same time their roughly rectangular shape provides an inflexible cleaning edge in the direction that is perpendicular to any dirt that protrudes above the surface. The effect of this combination of qualities allows the invention to effectively remove any stain on the surface of the material that is being cleaned. The material and structure of the invented material allows it to yield to the surface to be cleaned which lies parallel to the cleaning material, but be very unyielding to any dirt that obtrudes from the surface which in turn will be perpendicular to the cleaning material. This action not only allows the invented material to more effectively clean many combinations of surfaces and dirt that can already be addressed be currently available material, but also to effectively clean many combinations of surface and stains that heretofore were difficult or impossible. The wide range of cleaning materials currently available are proportionately abrasive to both the dirt to be removed and the surface to be cleaned thereby creating a tradeoff decision to be made by the user between effective dirt removal and potential of damage to the surface to be cleaned. Specifically, the invented material is the only nonchemical cleaning material that effectively and safely removes tar and bird stains from automobile finishes, bugs from windshields, calcium deposits from shower tiles and doors, scuff marks from no-wax floors, algae stains from vinyl and tile pool surfaces, barnacles from fiberglass boats, and similar tough cleaning tasks.

In addition, the basic invented material can be manufactured with various backings and formed in numerous ways so that the finished tool will be ideally suited to a specific cleaning task. E.g. steel wool would be difficult to form into the shape of a glove.

In addition, the invented material is nonabsorbent and inert so that cleaning chemicals can be easily rinsed out and the small amounts of water retained by surface tension can be released by a simple shaking of the material. This allows for rapid drying and quick storage without the danger of mildew. Sponges and cloths must be thoroughly rinsed and dried prior to storage to avoid mildewing and are easily subject to staining and mildewing.

In addition, the invented material can be used much like a brush on more textured surfaces by simply applying less pressure. Heretofore, it was necessary to have a wide range of cleaning materials to attempt to address the multitude of cleaning chores that are adequately addressed to the invented material.

In addition, since many cleaning chores require increased absorption characteristics, the invented material may be manufactured with an absorbent backing or with the addition of an absorbent material incorporated into the surface the provide the desired amount of absorption.

In addition, many chemicals can be used in combination with the invented material without damage. Heretofore, adverse chemical reactions could result when certain cleaning materials in combination with certain chemicals.

In summary, the invented material provides an effective cleaning solution to many tasks that were heretofore difficult or impossible and also provides the user with a multipurpose cleaner incorporated into one convenient device.

Further objects and advantages of the invention will become apparent from a consideration of the drawings and the ensuing description.

DESCRIPTION OF DRAWINGS

FIG. 1—12 fiber
- 16 tuft

FIG. 2—16 tuft
- 17 cleaning surface
- 18 scrim

FIG. 3—16 tuft
- 17 cleaning surface
- 18 scrim
- 19 optional absorbent material
- 20 impermeable liner FIG. 4—16 tufts
- 17*b* right-handed cleaning surface of mitt embodiment
- 17*a* left-handed cleaning surface of mitt embodiment
- 20 impermeable liner
- 26 four-finger pocket
- 28 thumb pocket
- 29 opening for hand
- 30 hanging loop
- 31 seam FIG. 5—17*b* right-handed cleaning surface of mitt embodiment
- 17*a* left-handed cleaning surface of mitt embodiment
- 20 impermeable liner
- 28 thumb pocket
- 26 four-finger pocket
- 30 hanging loop
- 34 hand FIG. 6—12 fiber
- 14 fiber edge
- 22 surface to be cleaned
- 24 dirt or stain FIG. 7—38 handle
- 17 cleaning material surface
- 40 hanging hole FIG. 8*a*—42 handle
- 44 sponge surface
- 46 base frame
- 47 hinged joint
- 17 cleaning material surface FIG. 8*b*—17 cleaning material surface
- 42 handle
- 44 sponge surface FIG. 9—50 hollow handle
- 52 locking pegs
- 54 neck
- 56 frame
- 17 cleaning material surface FIG. 10—58 absorbent material
- 17 cleaning material surface FIG. 11—58 absorbent material
- 17 cleaning material surface FIG. 12—17 cleaning material surface
- 62 absorbent material
- 64 five-finger pocket
- 66 protective liner.

DESCRIPTION OF THE PREFERRED EMBODIMENT OF THE INVENTION

Figure 1:
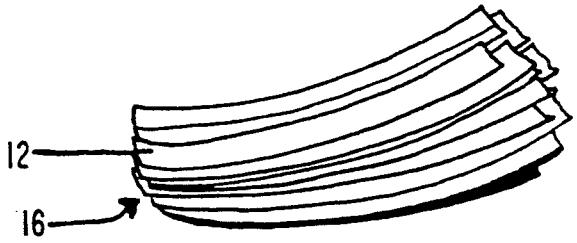
FIG. 1 is an perspective view of a group of flat cleaning fibers at a magnification of 4 times actual size showing the varying dimensions of individual cleaning fibers within a tuft. Magnification is 3 ×.

The invented material is made of a plurality of flat chisel-like synthetic fiber tufts protruding from a backing designed to hold the tufts in place. The synthetic fibers are flat and cut on their ends in a manner to produce in effect a small chisel or razor blade-like plastic. The fibers are somewhat flexible. FIG. 1 shows a group of individual fibers (12) combined into a tuft (16) lying flat prior to tufting. The fibers (12) are made of an extruded poylpropylene yarn which may be fiberlated to create varying widths of fibers. The length of the fibers (12) is approximately 0.75 inches and vary in width from 0.02 to 0.12 inches.

Figure 2:
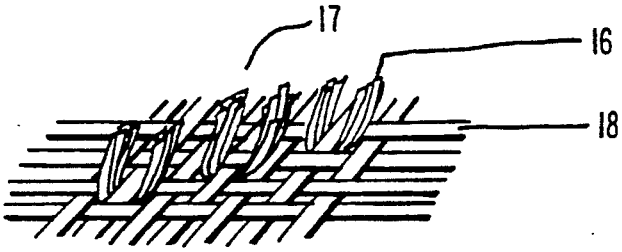
FIG. 2 shows a group of fibers or tuft as placed within the scrim in such a way to provide two front cleaning edges per fiber on the cleaning surface and placed at a slight angle from perpendicular to the plane of the scrim. This is at magnification 2 ×.

FIG. 2 shows approximately twenty of these various widthed fibers are joined into a group or tuft (16) and then temporarily positioned through a woven propylene backing or 'scrim' (18) in such a fashion that both ends protrude at a slight angle from the cleaning surface (17).

Figure 3:
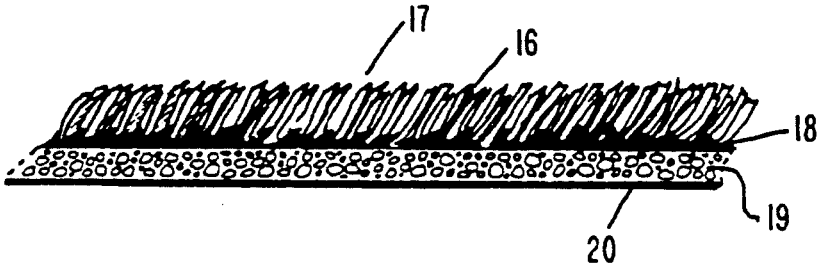
FIG. 3 shows the application of an extruded or glued backing to hold the tufts in their correct position and secondarily provide protection for the hand. The inclusion of an optional absorbent player is also shown. Magnification is 2 ×.

FIG. 3 shows that approximately fifty of these tufts (16) are placed within one square inch of the surface (17) of the invented material. This method creates about 2000 small plastic fibers per square inch (20 fibers per tuft times 2 ends per fiber times 50 tufts per square inch). The tufts (16) are held in place by an extruded backing (20). The drawing also depicts the potential inclusion of an absorbent material (19) if desired.

Figure 4:
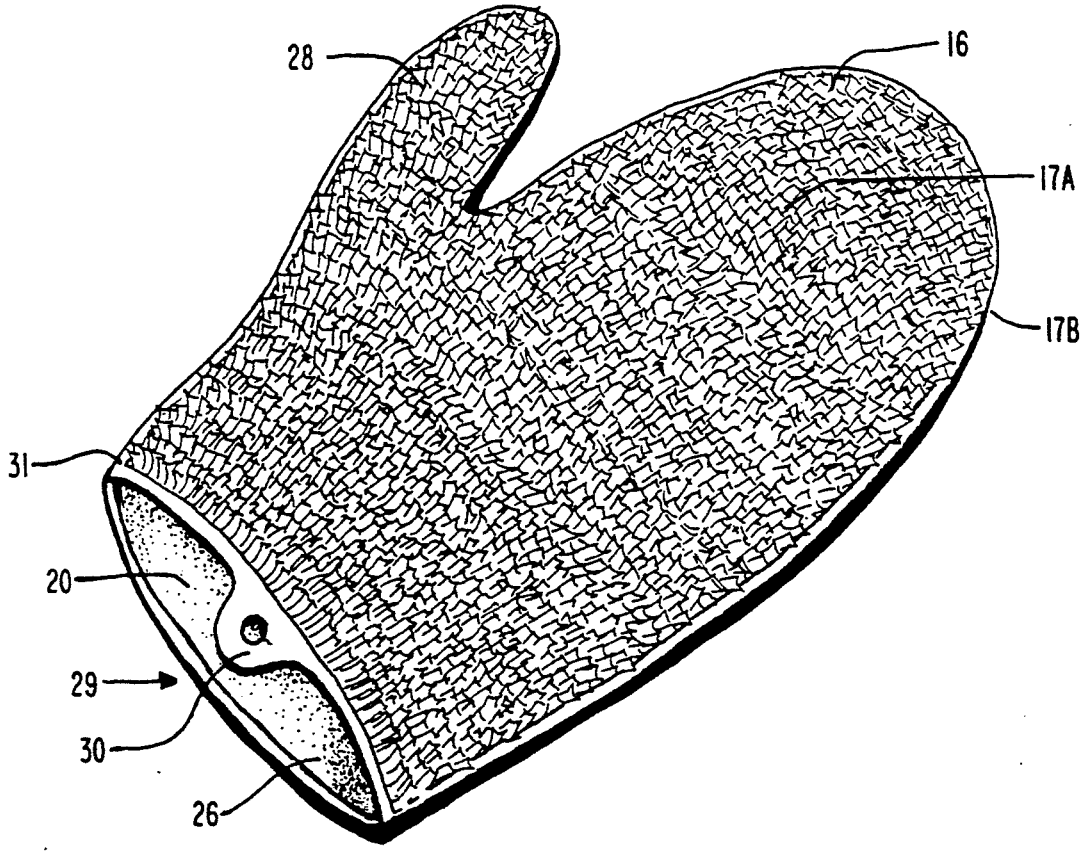
FIG. 4 is a perspective view of the mitt embodiment of the invented material showing the opening of the mitt, the protective liner, and the hanging hole. This is a separate pocket for the thumb to allow more dexterity in use. The unseen opposite (right-handed) side of the mitt also has the invented material facing outward and it would be the mirror image of this drawing. This provides an equivalent left-handed mitt in the same embodiment. Magnification is ½ ×.

FIG. 4 is a perspective view of a mitt embodiment of the invented material showing the opening (29) of the mitt and the protective liner (20) and left-hand primary cleaning surface (17*a*). Two layers of the invented material with backing are placed back to back and sealed in the shape of an oven mitt with a pocket designed for the four fingers (26) and a separate pocket for the thumb (28) with the addition of a hole (30) designed for hanging the glove. The seam (31) is continuous around the outside of the mitt except across the opening provided for the hand (29). The final result being an ambidextrous cleaning glove. The unseen bottom surface (17*b*) in this drawing would be the primary cleaning surface for a right-handed person.

Figure 5:
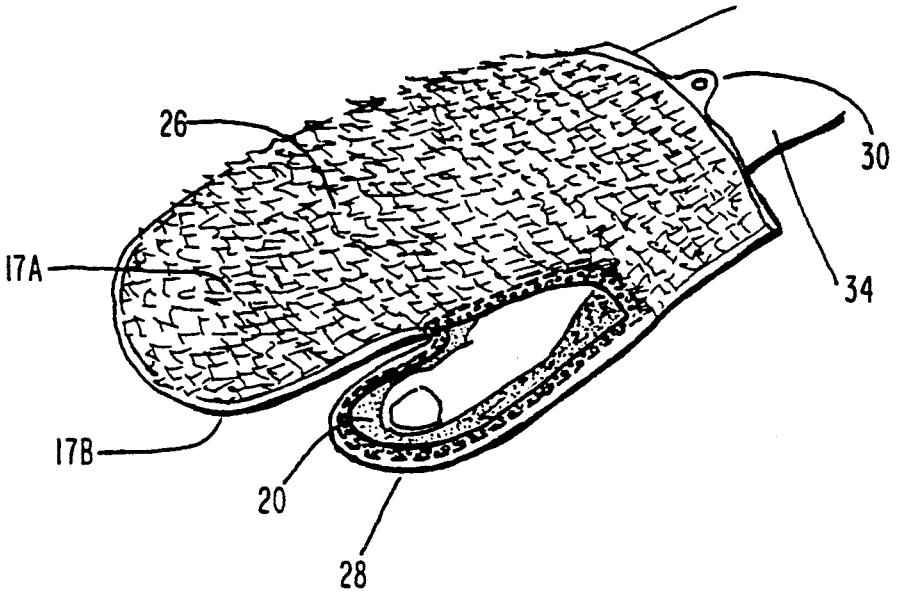
FIG. 5 shows a cutaway view of the mitt with the hand placed inside protected by the liner from the cleaning surface.

FIG. 5 shows a cutaway view of the mitt with the placement of the user's hand (34) inside. In this drawing a right hand is being used and the primary cleaning surface would be facing down (17*b*). If a left hand were used the drawing would be identical with the exception that the palm of the hand would be facing up and the primary cleaning surface would be that which is facing up (17*a*).

Figure 7:
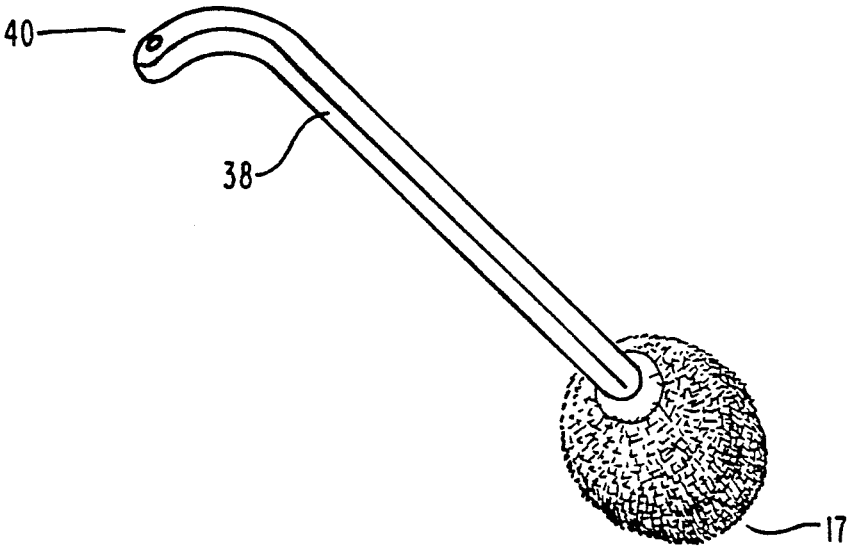
FIG. 7 shows a manner in which the invented material may be attached to a handle.

FIG. 7 shows one manner in which the invented material (17) may be attached to a handle (38) with a hanging hole (40) incorporated.

Figure 8A:
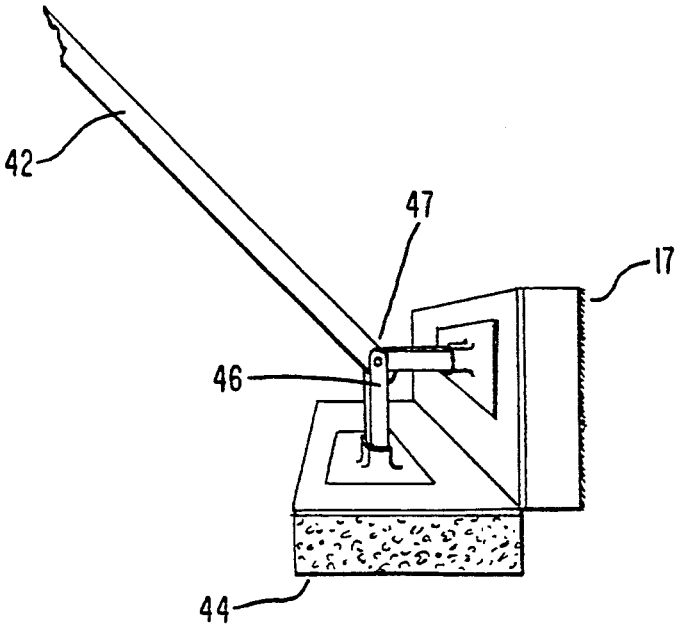
FIG. 8*a* shows a manner in which the invented material could be combined with an absorbent material with the two surfaces at right angles to one another and attached to a handle to be used as a mop.

FIG. 8*a* shows a manner in which the invented material (17) could be combined with an absorbent material (44) with the two surfaces at right angles to one another. The two surfaces would be fixed in this position by a supporting base frame (46) and both surfaces would be fixed at an angle of approximately 45 degrees to the pole (42) via a hinged or unhinged joint (47).

Figure 8B:
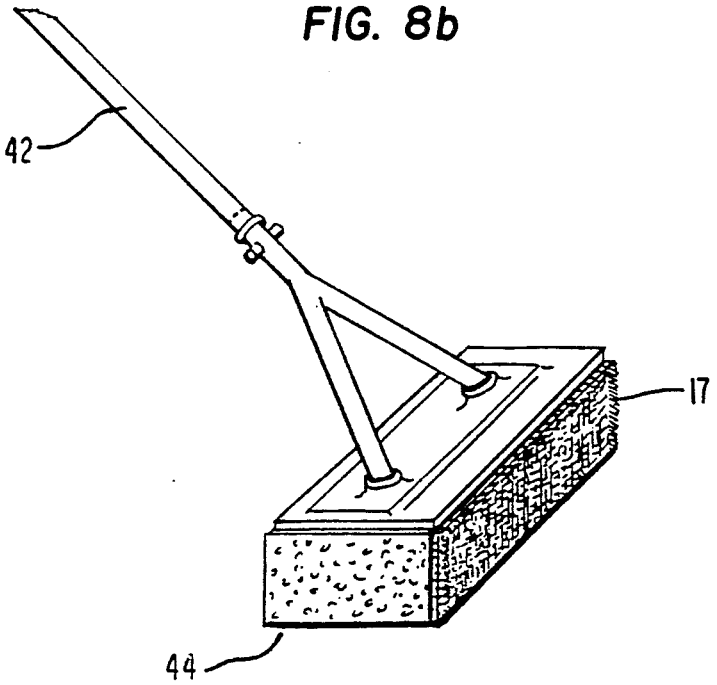
FIG. 8*b* shows another manner in which the invented material could be combined with an absorbent material with the two surfaces at right angles to one another and attached to a handle to be used as a mop.

FIG. 8*b* shows another manner in which the invented material (17) could be combined with an absorbent material (44) with the two surfaces at right angles to one another and attached to a handle (42).

Figure 9:
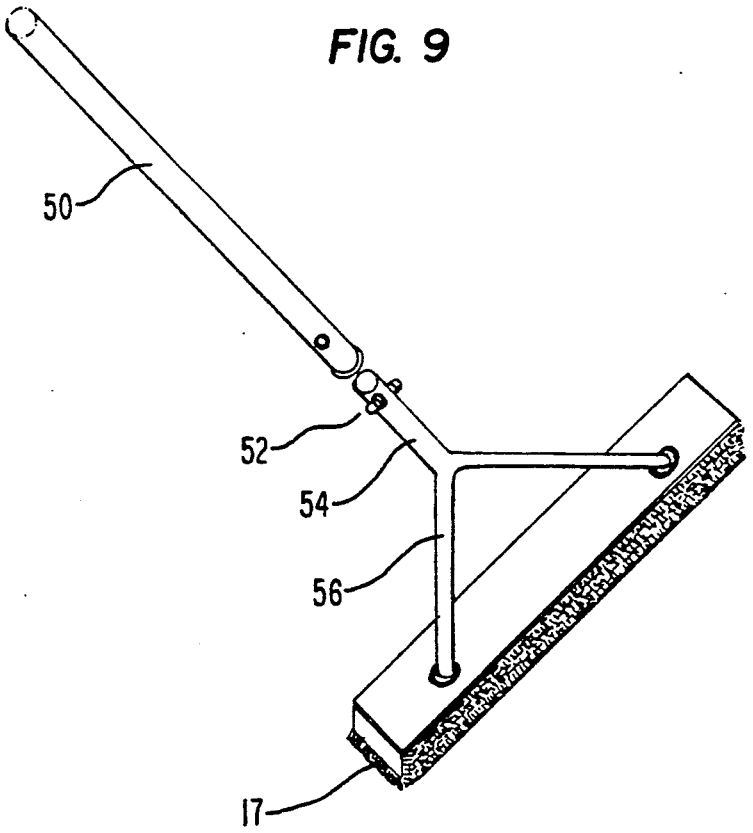
FIG. 9 shows a manner in which the invented material may be attached to an extended pole which may be used for cleaning pools or other areas where an extension is desirable.

FIG. 9 shows a manner in which the invented material (17) may be attached to a frame (56) which frame may be used as an attachment for standard hollow pool or vacuum cleaner poles (50) utilizing depressable locking pegs (52) attached to the neck (54) of the frame (56) of the attachment.

Figure 10:
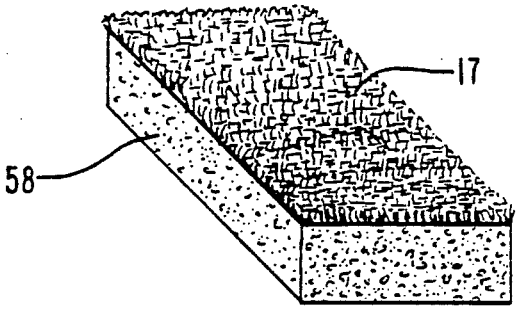
FIG. 10 shows a manner in which the invented material is applied to the surface of a sponge.

FIG. 10 shows a manner in which the invented material (17) would be attached to the surface of a sponge or other absorbent material (58).

Figure 11:
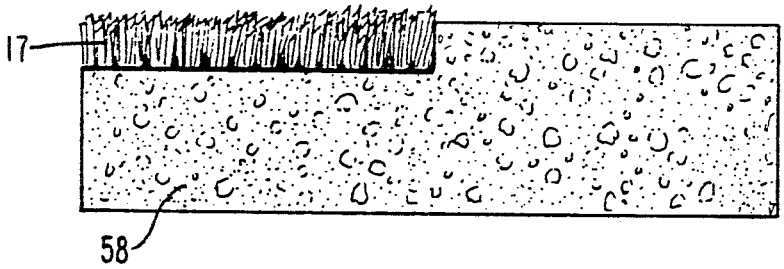
FIG. 11 shows the manner in which the invented material may be combined with an absorbent material on the same surface to provide both cleaning and drying within one surface.

FIG. 11 shows the manner in which the invented material (17) may be combined with an absorbent material (58) on the same surface.

Figure 12:
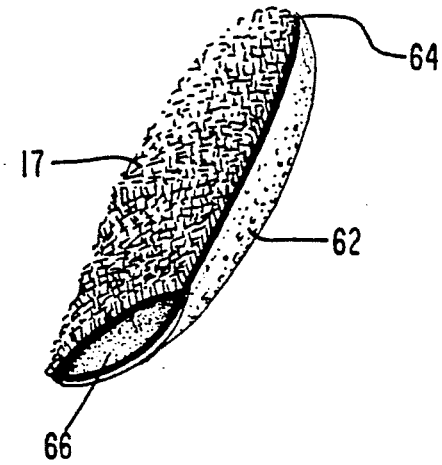
FIG. 12 shows a manner in which the invented material may be formed into a mitt form with a pocket for the hand with one surface of the mitt being comprised of the invented material and the reversed surface of the mitt being of an absorbent material.

FIG. 12 shows a manner in which the invented material (17) may be formed into a mitt form with a pocket (64) for the hand, with one surface of the mitt being comprised of the invented material (17) and the reverse surface (62) of the mitt being of an absorbent material with a protective liner (66) incorporated inside the pocket.

OPERATION OF THE INVENTION

Figure 6:
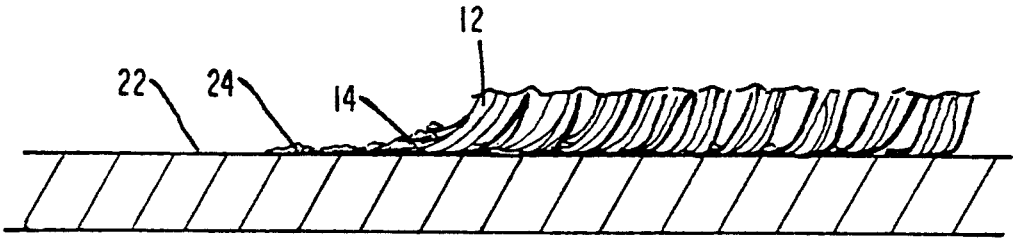
FIG. 6 shows the manner in which the invented material works upon a dirty surface. Note that the plurality of flat fibers are at right angles to the dirt but parallel to the surface to be cleaned.

In the preferred embodiment of the invention the user would apply water and/or chemicals if desired to either the surface to be cleaned or to the invented material itself. The surface of the material would then be applied to the surface to be cleaned and rubbed back and forth to remove dirt and stains. FIG. 6 shows the operation of the fibers (12) upon the surface to be cleaned (22). The chisel like fibers (12) have some flexibility along the axis of the length of the fibers which allows them to lay down parallel to the surface to be cleaned and thereby present the cutting edge of the fiber at a perpendicular to the dirt to be removed (24). The fibers are very inflexible along the axis of their width due to their shape and their being secured in the backing. This in turn allows no place for the fiber to go upon encountering the dirt except to go through it. This works in much the same way that a flexible metal ruler would lay down next to a table top but would not yield left or right when pushing the ruler forward across the table. The relative thinness of the fibers combined with pressure applied by the user is such that the path of least resistance for the cutting edge is to undercut the dirt or stain next to the surface. The dirt then rides up and over the fiber and is temporarily trapped between fibers. Upon releasing the pressure between fibers by removing the invented cleaning material from the surface, the fibers will tend to return to their original shape and release any entrapped dirt. Rinsing and shaking the material will release most of the dirt and the material may be easily placed to dry and be available for the next use. Thus the reader will see that the invention provides a convenient and effective cleaning material that can be used for both some specific cleaning chores that heretofore were not adequately addressed by currently available cleaning materials and provide one convenient material for a multitude of more conventional cleaning tasks.

In the mitt embodiment of the invention the use would place either hand into the mitt with the thumb placed separately from the four fingers. The user would then apply the cleaning method stated above and upon finishing hang the mitt up by utilizing the hanging hole. In the mitt embodiment the tufts are held in place by a laminated backing which also serves to provide an impermeable layer to liquids, and provide a soft texture to protect the user's skin, and provide a method to allow for manufacturing by way of thermal impulse melting or glueing.

In the short handled embodiment of the invention the user would grasp the handle and then utilize the cleaning method as described above for the cleaning of toilets and other inaccessible or particularly dirty chores.

In the long handle or mop embodiment of the invention the user would use the device in much the way as an ordinary mop with the added action that the user would first apply the surface of the invented material to the surface to be cleaned and after loosening all stubborn stains and dirt the user would turn the handle 180 degrees in order to present the absorbent surface of the mop to the surface allowing easy clean up of the loosened dirt and liquid.

In the extended or pool cleaning embodiment of the invention the user would attach the invented material attachment to the pole in much the same manner as done with conventional attachments and apply the invented material to the surface to be cleaned as stated above.

In the sponge backed embodiment of the invention the user would first apply the surface of the invented material to the surface to be cleaned and after loosening all stubborn stains and dirt the user wold turn the device over in order to present the absorbent surface of the mop to the surface allowing easy clean up of the loosened dirt and liquid.

In the embodiment of the invention that combines an absorbent material on the same surface as the invented material the user would both scrub and absorb with the single surface device.

In the embodiment of the invention that combines an absorbent material on one side and the invented material on the second side of a mitt the user would first apply the surface of the invented material to the surface to be cleaned and after loosening all stubborn stains and dirt the user would turn the device over in order to present the absorbent surface of the mitt to the surface allowing easy clean up of the loosened dirt and liquid.

I claim:

1. A cleaning material formed into a cleaning mitt that will fit over a user's hand, the cleaning material comprising a woven scrim having a first side and a second side, a stabilizing backing on the first side of said woven scrim, and a plurality of flat synthetic fibers protruding from said woven scrim on said second side thereof, said synthetic fibers being capable of removing dirt from surfaces with minimal damage to the surface being cleaned, said backing including a soft, substantially impermeable layer having a soft surface to protect skin and providing substantial impermeability to liquids.

2. The cleaning mitt in claim 1, wherein the mitt has a front surface and back surface and is formed with a pocket to accept the four fingers of either hand and a separate pocket for the thumb with both the front and rear surfaces of the mitt made with the cleaning material whereby an ambidextrous cleaning mitt is made available.

3. A glove having a thumb pocket and a finger pocket, said glove being made of a material comprising a backing which is substantially impermeable to liquids, and a plurality of fiber tufts, each said fiber tuft being made of a plurality of flat fibers which are grouped to form said tuft, said fibers varying in width and being made of a synthetic material, each said fiber tuft being attached to said backing such that most of the fibers thereof extend at a slight angle to said backing, and wherein said plurality of fiber tufts are exposed on substantially all exterior surfaces of said glove.

4. The glove in claim 3, wherein each fiber tuft includes approximately forty exposed fibers, and approximately fifty fiber tufts are attached to approximately one square inch of said backing, thereby providing approximately two thousand fibers exposed within approximately one square inch of said backing.

* * * * *

UNITED STATES PATENT AND TRADEMARK OFFICE

CERTIFICATE OF CORRECTION

PATENT NO. : 5,134,746

DATED : August 4, 1992

INVENTOR(S) : Steven R. Willman

It is certified that error appears in the above-identified patent and that said Letters Patent is hereby corrected as shown below:

On the title page, under item [19] and in item [76] the last name of the Inventor, "William" should read --Willman--.

UNITED STATES PATENT AND TRADEMARK OFFICE

CERTIFICATE OF CORRECTION

PATENT NO. : 5,134,746

DATED : August 4, 1992

INVENTOR(S) : Steven R. Willman

It is certified that error appears in the above-identified patent and that said Letters Patent is hereby corrected as shown below:

Column 1, line 33, "direct" should read --dirt--.

Column 2, line 31, "to" should read --by--.

Column 2, line 36, second occurrence of "the" should read --to--.

Column 2, line 41, insert --using-- before first occurrence of "certain".

Column 3, line 1, "This" should read --There--.

Column 3, line 38, "reversed" should read --reverse--.

Column 4, line 41, "poylpropylene" should read --polypropylene--.

Column 4, line 41, "fiberlated" should read --fibrillated--.

Column 4, lines 47-48, "propylene" should read --polypropylene--.

Column 6, line 16, "use" should read --user--.

Column 6, line 49, "wold" should read --would--.

Column 6, line 56, "surface" should read --surfaced--.

Signed and Sealed this

Sixteenth Day of November, 1993

Bruce Lehman

*Attest:*

BRUCE LEHMAN

*Attesting Officer*

*Commissioner of Patents and Trademarks*